US012207700B2

(12) United States Patent
Casali et al.

(10) Patent No.: US 12,207,700 B2
(45) Date of Patent: Jan. 28, 2025

(54) FOOTWEAR DYNAMIC SOLE

(71) Applicant: WAHU S.R.L., Milan (IT)

(72) Inventors: Patrizia Casali, Milan (IT); Fanny Boria, Milan (IT); Mattia De Santis, Tribiano (IT); Ivo Emanuele Francesco Boniolo, Bovisio Masciago (IT)

(73) Assignee: WAHU S.R.L., Milan (IT)

( * ) Notice: Subject to any disclaimer, the term of this patent is extended or adjusted under 35 U.S.C. 154(b) by 445 days.

(21) Appl. No.: 17/593,936

(22) PCT Filed: Mar. 25, 2020

(86) PCT No.: PCT/IB2020/052806
§ 371 (c)(1),
(2) Date: Sep. 28, 2021

(87) PCT Pub. No.: WO2020/201925
PCT Pub. Date: Oct. 8, 2020

(65) Prior Publication Data

US 2022/0175086 A1 Jun. 9, 2022

(30) Foreign Application Priority Data

Mar. 29, 2019 (IT) ..... 102019000004763

(51) Int. Cl.
*A43B 13/22* (2006.01)
*A43B 3/24* (2006.01)

(52) U.S. Cl.
CPC ..... *A43B 13/22* (2013.01); *A43B 3/246* (2013.01)

(58) Field of Classification Search
CPC ..... A43B 13/22; A43B 3/246; A43B 13/12; A43B 13/223; A43B 15/161; A43B 5/0466; A43B 7/24; A43C 15/14; A43C 15/161
See application file for complete search history.

(56) References Cited

U.S. PATENT DOCUMENTS 47,521 A * 5/1865 Clarke ..... A43B 13/223 36/59 A
264,105 A * 9/1882 Rust ..... A43C 15/14 36/61

(Continued)

FOREIGN PATENT DOCUMENTS

EP 2355675 A2 8/2011
JP H08299025 A 11/1996

(Continued)

OTHER PUBLICATIONS

International Search Report and Written Opinion for Corresponding International Application No. PCT/IB2020/052804, Jul. 2, 2020, 8 pages.

(Continued)

*Primary Examiner* — Heather Mangine
*Assistant Examiner* — Raquel M. Weis
(74) *Attorney, Agent, or Firm* — LUCAS & MERCANTI, LLP

(57) ABSTRACT

The present description relates to a footwear sole (1) comprising a first layer (2) having a leaning surface (3) and a second layer (4), coupled to said first layer (2), associated with a plurality of seats (5). The sole (1) moreover comprises a plurality of actuated members (6) each of which mounted in a respective seat (5) and movable or shift-able between a first position, or retracted position, and a second position, or extended position, wherein in the respective first position they are apt to determine a first configuration of the first layer (2) and in the second position they are apt to determine a second configuration of the first layer (2) wherein the leaning surface (3) has or forms a plurality of bumps or protrusions with respect to the first configuration. The sole (1) further comprises an actuation member (7) configured to move the actuated members (6) between the first position and the second position, and vice versa. The present descrip- (Continued)

tion also relates to a method which can be realized by this sole, as well as to a footwear comprising this sole.

23 Claims, 4 Drawing Sheets

(56) References Cited

U.S. PATENT DOCUMENTS 351,415 A * 10/1886 Weller ..... A43C 15/14 36/61
851,240 A * 4/1907 Leibert ..... A43C 15/14 36/61
1,361,078 A * 12/1920 Henry ..... A43C 15/168 135/81
1,607,296 A * 11/1926 Noel ..... A43C 15/14 36/61
2,920,404 A * 1/1960 Ross ..... A43C 15/14 36/61
3,337,972 A * 8/1967 Stollman ..... A43C 15/09 36/1
3,716,931 A * 2/1973 Loudermilk ..... A43B 5/001 36/61
3,717,238 A * 2/1973 Fox ..... A43B 5/0415 36/61
3,793,751 A * 2/1974 Gordos ..... A43C 15/14 36/134
4,358,902 A 11/1982 Cole et al.
4,375,729 A * 3/1983 Buchanen, III ..... A43C 15/14 36/134
4,821,434 A * 4/1989 Chein ..... A43C 15/14 36/134
4,825,562 A * 5/1989 Chuang ..... A43C 15/14 36/134
5,222,312 A * 6/1993 Doyle ..... A43B 13/203 36/28
5,269,080 A * 12/1993 Davis ..... A43C 15/14 36/114
5,299,369 A * 4/1994 Goldman ..... A43C 15/14 36/61
5,337,494 A * 8/1994 Ricker ..... A43C 15/14 36/134
5,456,027 A * 10/1995 Tecchio ..... G01L 5/03 403/321
5,497,565 A * 3/1996 Balgin ..... A43C 15/14 36/134
5,737,855 A * 4/1998 Jordan ..... A43B 5/001 36/134
6,125,556 A * 10/2000 Peckler ..... A43C 15/14 36/134
6,256,907 B1 * 7/2001 Jordan ..... A43C 15/14 36/134
7,316,081 B1 1/2008 Cheng
8,510,973 B2 * 8/2013 Bachmann ..... A43C 15/14 36/61
9,913,512 B2 * 3/2018 Bachmann ..... A43B 3/0042
2004/0040181 A1 * 3/2004 Kim ..... A43B 5/001 36/144
2005/0229434 A1 * 10/2005 Yoo ..... A43C 15/063 36/62
2008/0016721 A1 * 1/2008 Obeydani ..... A43C 15/14 36/61
2008/0066348 A1 * 3/2008 O'Brien ..... A43C 15/168 36/61
2010/0229428 A1 * 9/2010 Bachmann ..... A43C 15/14 36/134
2011/0047830 A1 3/2011 Francello et al.
2011/0126422 A1 6/2011 Vattes et al.
2011/0162235 A1 * 7/2011 Bachmann ..... A43C 15/08 36/61
2012/0222329 A1 * 9/2012 Pennerath ..... A63C 17/02 36/100
2015/0305445 A1 * 10/2015 Bachmann ..... A43B 3/0042 36/61
2017/0071289 A1 * 3/2017 Auyang ..... A43B 13/04
2019/0075883 A1 * 3/2019 Park ..... A63C 17/18
2019/0298002 A1 * 10/2019 Chen ..... A43C 15/14
2022/0175078 A1 * 6/2022 Casali ..... A43B 13/206
2022/0175086 A1 * 6/2022 Casali ..... A43B 13/22

FOREIGN PATENT DOCUMENTS

KR 101591036 B1 2/2016
NO 316251 B1 1/2004
WO 0008962 A1 2/2000
WO 2020201923 A1 10/2020
WO WO-2020201925 A1 10/2020

OTHER PUBLICATIONS

Office Action for Corresponding Chinese Patent Application No. 202080039580.9, dated Aug. 11, 2023, pp. 1-9, English translation 17 pages.
International Search Report and Written Opinion for International Application No. PCT/IB2020/052806, European Patent Office, Netherlands, mailed on Jun. 12, 2020, 17 pages.

* cited by examiner

FOOTWEAR DYNAMIC SOLE

TECHNICAL FIELD

The present description refers in general to the footwear production field, and more specifically it relates to a footwear sole the structure of which can be dynamically modified by the user and a related method for modifying the structure of a footwear sole. The present description also relates to a footwear comprising such sole.

TECHNICAL BACKGROUND

Slippage is one of the main risks a user incurs during his working/non-working activities. Slippage is caused by the decrease in the adhesion between the sole and the walking surface. Said decrease in the adhesion occurs when the ratio between the horizontal component and the vertical component of the force impressed by the user's foot on the leaning surface falls below the friction coefficient between the same sole and the leaning surface.

In order to reduce the slippage risk, only specific compounds or specific designs have been studied to optimize the adherence of the sole with a certain type of walking surface. However, these are substantially "static" solutions that do not allow adapting the characteristics of the sole to those of the walking surface. In fact, since during the performance of his activities the user may find himself walking on surfaces with different characteristics or on surfaces the characteristics of which vary due to weather conditions, the use of footwears with soles according to the known technique resolve only partially the slippage problem.

SUMMARY OF THE DESCRIPTION

In light of the above, the present description aims to provide a footwear sole which allows to overcome the drawbacks above mentioned with reference to the prior art and/or to obtain further advantages. This is achieved through a footwear sole and a method as defined in the respective independent claims. Secondary characteristics and specific embodiments of the object of the present description are defined in the corresponding dependent claims.

The footwear sole according to the present description comprises a first layer having a leaning surface configured to face, in use, or during a user's walk, a walking surface. The sole according to the present description further comprises a second layer, coupled to the first layer, and a plurality of seats each associated with the second layer. The sole further comprises a plurality of actuated members, each of which is mounted in a respective seat, in particular a niche, and is movable or shift-able between a first position, or a retracted position, and a second position, or an extended position. In said first position, these actuated members are housed in a respective seat, while in said second position they protrude at least partially from a respective seat towards the first layer. In other words, in the extended position the actuated members protrude towards the leaning surface of the footwear sole. The sole according to the present description further comprises an actuation member configured to move the actuated members between the first position and the second position, and vice versa. The actuated members in the respective first position are apt to determine a first configuration of the first layer, while in the second position they are apt to determine a second configuration of the first layer wherein the leaning surface has or forms a plurality of bumps or protrusions with respect to the first configuration.

The term "bumps" means within the scope of the present disclosure a plurality of protuberances, of protruding elements in a more or less pronounced way or similar elements apt to determine a more or less accentuated roughness on the walking surface.

These bumps or protrusions are arranged at each actuated member. Consequently, The formation of bumps protrusions or swellings on the first layer, when it is in said second configuration, determines an extension of the leaning surface of the sole. It follows that, advantageously, in case of uneven walking surfaces, being the contact surface between the footwear sole and the walking surface greater, the friction coefficient between the sole itself and the leaning surface increases and the slippage risk for a user decreases. In other words, especially in the case, for example, of soft, grassy, snowy or muddy ground, the contact surface between the sole and the ground, thanks to the presence of said bumps or protrusions, is increased compared to the first configuration of the first layer thus increasing the friction coefficient between the leaning surface and the walking surface.

According to a preferred aspect of the present description, in the first configuration of said first layer, the leaning surface is substantially flat or free of protrusions. It follows that, thanks to the presence of the plurality of actuated members and the actuation member allowing the movement of said actuated members, the leaning surface of the sole can be modified from a substantially flat or flat configuration, suitable for even walking surfaces such as, for example, floors in offices or houses, into a configuration with bumps or protrusions, suitable for uneven walking surfaces.

According to a further preferred aspect, in the footwear sole according to the present description, the second layer forms with the first layer an expandable chamber, or expansion chamber. The movement of the actuated members determines the contraction or expansion of said expandable chamber, or expansion chamber, wherein this contraction or expansion changes the configuration of the first layer. In other words, in the transition from the retracted position to the extended position, the actuated members are configured to move away or distance the second layer from the first layer, thus causing an expansion of said expansion chamber. That is to say that the first position of the actuated members, i.e. the retracted position, corresponds to a maximum proximity or closeness of the first layer with respect to the second layer at the expansion chamber, while the second position of the actuated members, or extended position, corresponds to a maximum distance or separateness of the first layer from the second layer, at the expansion chamber. This means that the first position, i.e. the retracted position, of the actuated members causes a maximum closeness of the first layer to the second layer at the expansion chamber; while the second position, i.e. in the extended position, of the actuated members causes a maximum distance or separateness of the second layer from the first layer in at the expansion chamber.

According to this preferred aspect, the actuated members are arranged inside said expandable chamber, or expansion chamber. The actuated members are therefore housed within said expansion chamber. The actuated members are thus arranged between the first layer and the second layer. In other words, the actuated members are separated from the walking surface by the leaning surface of the sole. Therefore, such actuated members are protected from direct contact with the ground, thus reducing the risk of breakage of such elements.

According to a preferred aspect of the present description, in the first position, or retracted position, the actuated members are completely housed, or foldaway, in a respective seat of the plurality of seats. Consequently, the configuration of the first layer when the actuated members are completely retracted, is such as to obtain a flat or bump-free leaning surface.

According to a further preferred aspect, each actuated member is rotatably mounted in the respective seats and is configured to rotate between the first position and the second position and vice versa. Furthermore, the footwear sole comprises a main development direction arranged, in use, parallel to the main development direction of a user's foot, or parallel to a user's walking direction, and each actuated member is an eccentric shaped element, or cam, fitted on a rotation axis arranged perpendicularly to said main development direction of the sole. According to this aspect, the footwear sole according to the present description is characterized by a second layer which has a smaller bulk, or a smaller thickness, compared to a configuration wherein the actuated members are sliding or translatable vertically with respect to the second layer itself.

According to a preferred aspect of the description, the actuation member comprises at least two tie-members configured to rotate in parallel a plurality of actuated members from the first position to the second position. It follows that all the actuated members of the sole can be moved from the retracted position to the extended position simultaneously.

According to a further preferred aspect of the present description, the actuation member comprises a rotor connected to the tie-members and configured to control the tie-members tensioning. In addition, each actuated member comprises a hole and at least one tie-member element is inserted in such hole. A rotation of the rotor in a first rotation direction is therefore apt to cause a movement of the actuated members from the first position to the second position by means of the tie-members.

According to a further preferred aspect of the present description, the actuation member further comprises a torsion spring housed inside each of the seats and connected to a respective actuated member. Such torsion springs are arranged so that the rotation of the rotor in the first rotation direction is apt to cause a twisting movement and a loading of the torsion springs themselves, and a rotation of the rotor in the opposite rotation direction is apt to release the tie-members and torsion springs and to allow rotation of the actuated members from the second position to the first position under the action of the torsion springs. Consequently, according to this aspect, to move the actuated members from the second position to the first position, it is sufficient to rotate the rotor in the opposite direction with respect to the first rotation direction.

According to a further preferred aspect of the present description, the rotor is arranged at an end region of the sole. According to this aspect, the position of the rotor is of minimum hindrance for a user during the use of the sole.

Furthermore, according to another aspect of the present description, the rotor can be operated manually or electronically. That is to say that the rotor is operable, i.e. operable, by the user or electrically.

The present description has as further object a footwear comprising a sole.

Finally, the present description relates to a method for modifying the configuration of a leaning surface of a footwear sole, wherein said leaning surface is configured to face, in use, a walking surface. The method comprises a step of providing a first layer of a footwear sole wherein said first layer defines this leaning surface and of coupling this first layer with a second layer. The method then provides providing a plurality of seats each associated with the second layer and providing a plurality of actuated members each of which mounted in respective seat. Each actuated member can be moved between a first position, or retracted position, wherein it is housed inside a respective seat, and a second position, or extended position, wherein it protrudes at least partially from a respective seat towards the first layer. It is also provided an actuation member configured to move the actuated members and said plurality of actuated members is moved between the first position, or retracted position, and the second position, or extended position. The plurality of actuated members in the respective first position, or retracted position, are apt to determine a first configuration of the first layer, while in the respective second position, or extended position, they are apt to determine a second configuration of the first layer in wherein in said second configuration of the first layer, the leaning surface has or forms a plurality of bumps or protrusions with respect to the first configuration of the first layer at each actuated member.

According to a preferred aspect of the aforementioned method, said second layer defines with said first layer an expandable chamber, or expansion chamber.

According to a further preferred aspect of the aforementioned method, the movement of the actuated members causes a contraction or expansion of the expandable chamber, or expansion chamber, which changes the configuration of the first layer.

According to a further preferred aspect of the aforementioned method, each actuated member of the plurality of actuated members is rotatably mounted in a respective seat of the plurality of seats and is apt to rotate between the first position, or retracted position, and the second position, or extended position , and viceversa.

According to a further preferred aspect of the aforementioned method, the sole comprises a main development direction arranged, in use, parallel to the main development direction of the foot of a user, and wherein each actuated member of the plurality of actuated members is an eccentric shaped element, or cam, fitted on an rotation axis perpendicular to said main development direction of the sole. According to this preferred aspect, moreover, each actuated member of the plurality of actuated members has a main development axis, said main development axis being substantially parallel to the main development direction of the sole in said first position, or retracted position, and substantially perpendicular to the main development direction of the sole in said second position, or extended position.

According to a further preferred aspect of the aforementioned method, providing said actuation member comprises providing at least two tie-members configured to rotate in parallel, i.e. simultaneously, a plurality of actuated members each from the first position, or retracted position, to the second position, or extended position. According to this preferred aspect, providing said actuation member further comprises providing a rotor, configured to control the tie-members tensioning, and connecting said rotor to the at least two tie-members.

In addition, according to this preferred aspect of the aforementioned method said step of moving said plurality of members actuated between the first position, or retracted position, and the second position, or extended position, and vice versa comprises rotating the rotor in a first rotation direction for tensioning the tie-members, causing a movement of the respective member actuated from the first position, or retracted position, to the second position, or extended position.

According to this preferred aspect of the aforementioned method, providing said actuation member further comprises providing a torsion spring for each actuated member of the plurality of actuated members, coupling said torsion spring to an actuated member of the plurality of actuated members, housing said torsion spring in the respective seat of the actuated member of the plurality of actuated member which it is coupled to.

Finally, according to this preferred aspect of the aforementioned method, said step of moving said plurality of actuated members between the first position, or retracted position, and the second position, or extended position, and vice versa comprises:

rotating the rotor in the first rotation direction, causing a twisting movement of the tie-members and a loading of the torsion springs, wherein said twisting movement of the tie-members causes a movement of the actuated members from the first position, or retracted position, to the second position, o extended position, and impedes the release of the torsion springs by preventing the movement of the actuated elements from the second position, o extended position, to the first position, or retracted position;

rotating the rotor in a second rotation direction, opposite to the first, causes a loosening of the tie-members which allows the torsion springs to move the actuated members from the second position, or extended position, to the first position, or retracted position.

BRIEF DESCRIPTION OF THE DRAWINGS

Further advantages, characteristics and the uses of the object of the present description will be clear from the following detailed description of embodiments thereof, presented as non-limiting examples.

It is however evident that each embodiment of the object of the present description can have one or more of the advantages listed above; in any case it is not required that each embodiment simultaneously has all the listed advantages.

Figure 1:
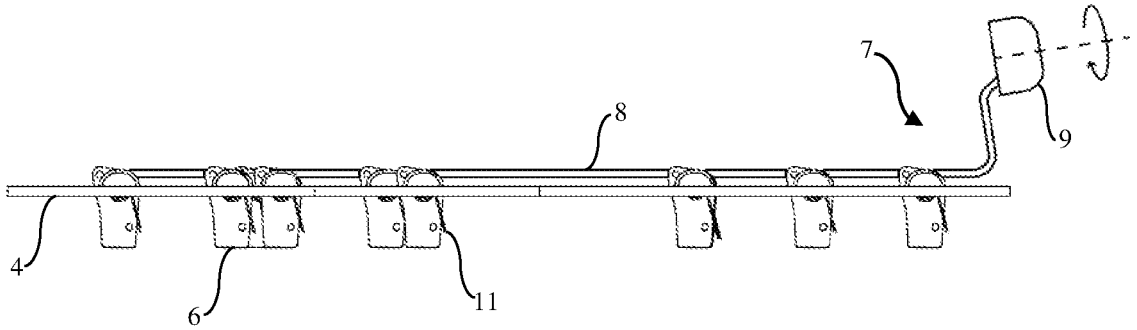
Figure 2:
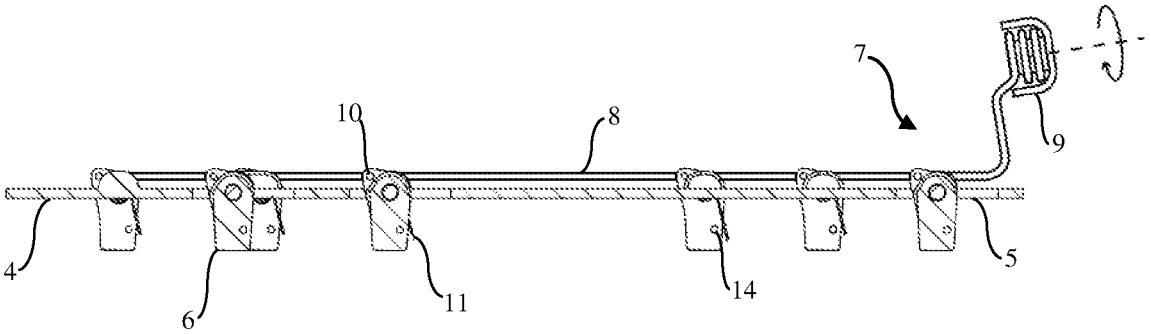
Figure 3:
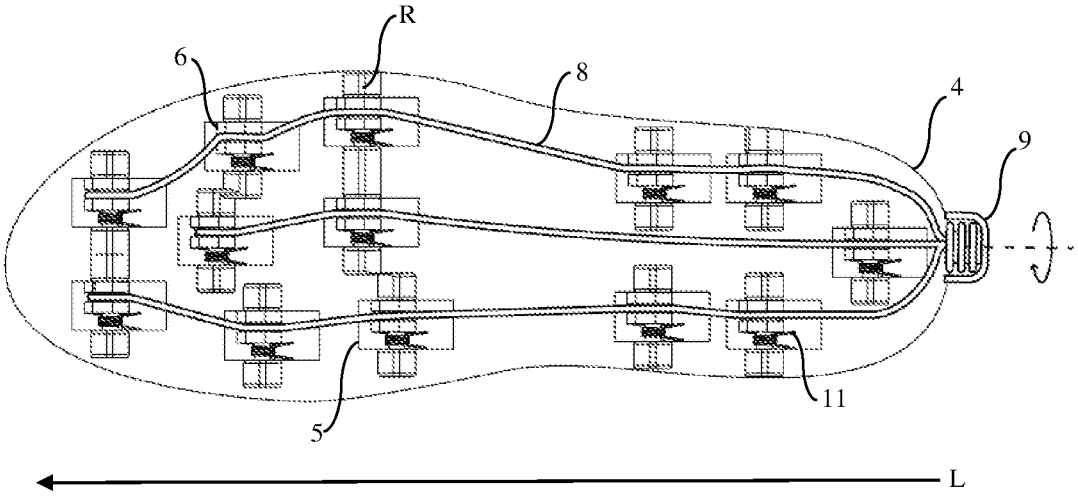
Figure 4:
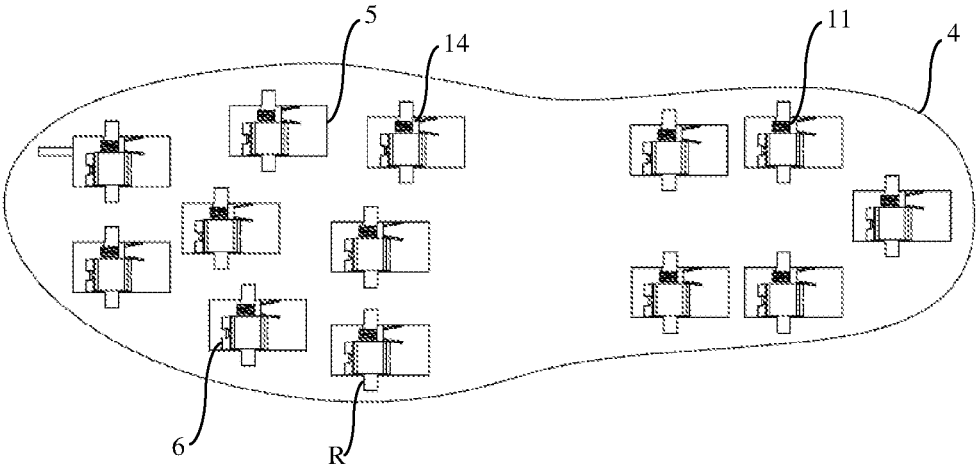
Figure 5:
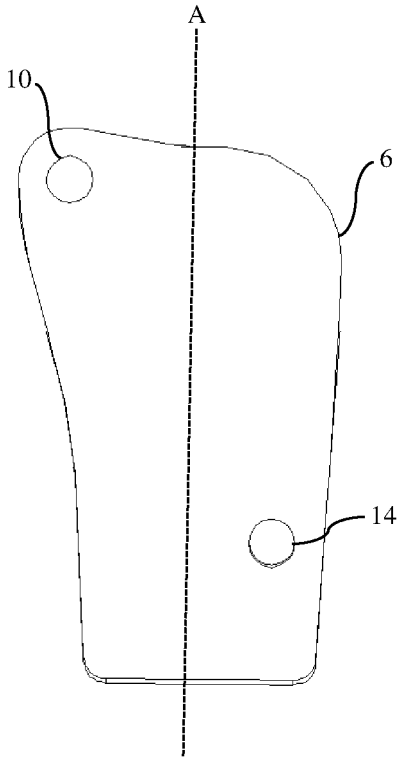
Figure 6:
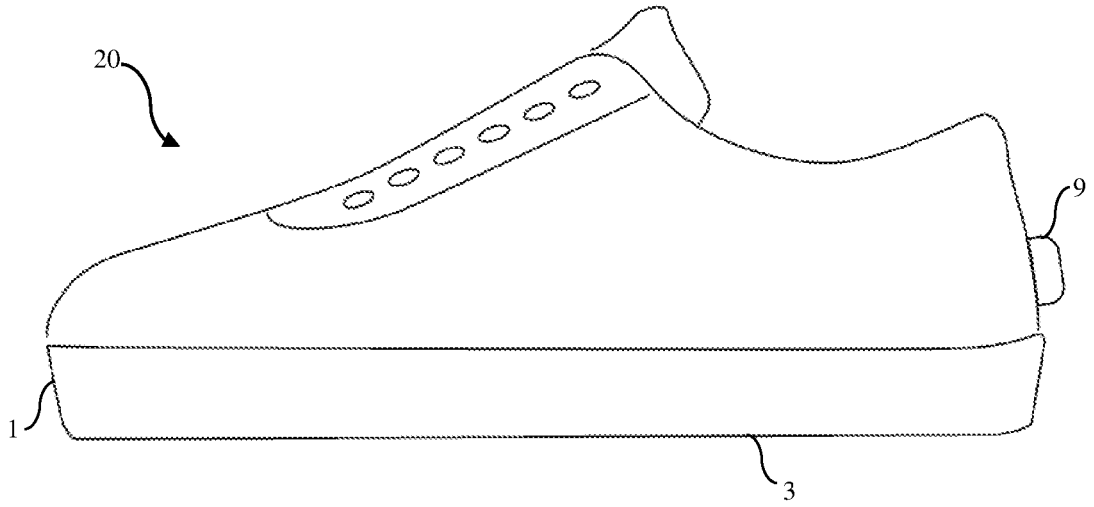
Figure 7:
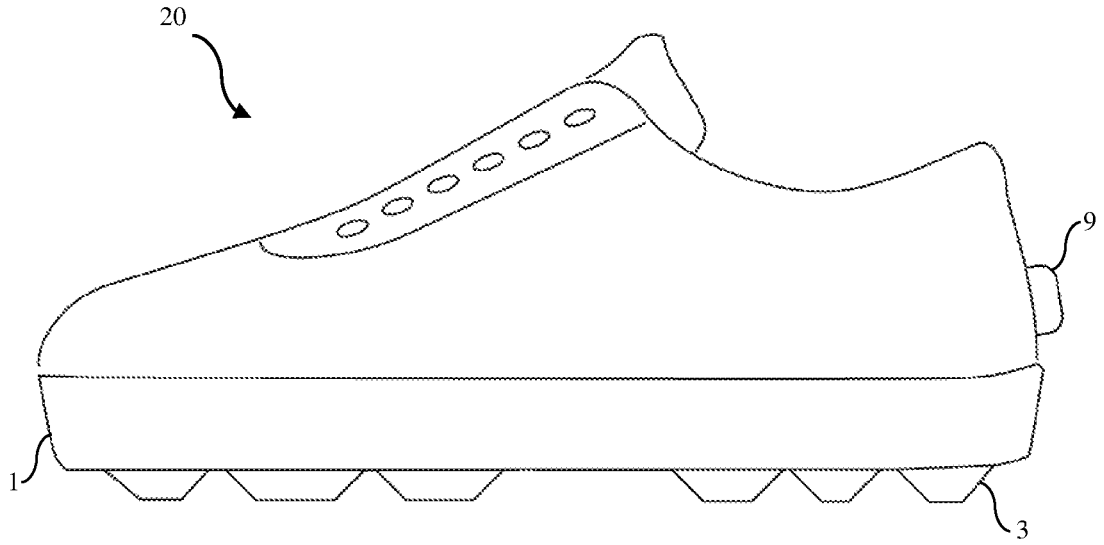
Figure 8:
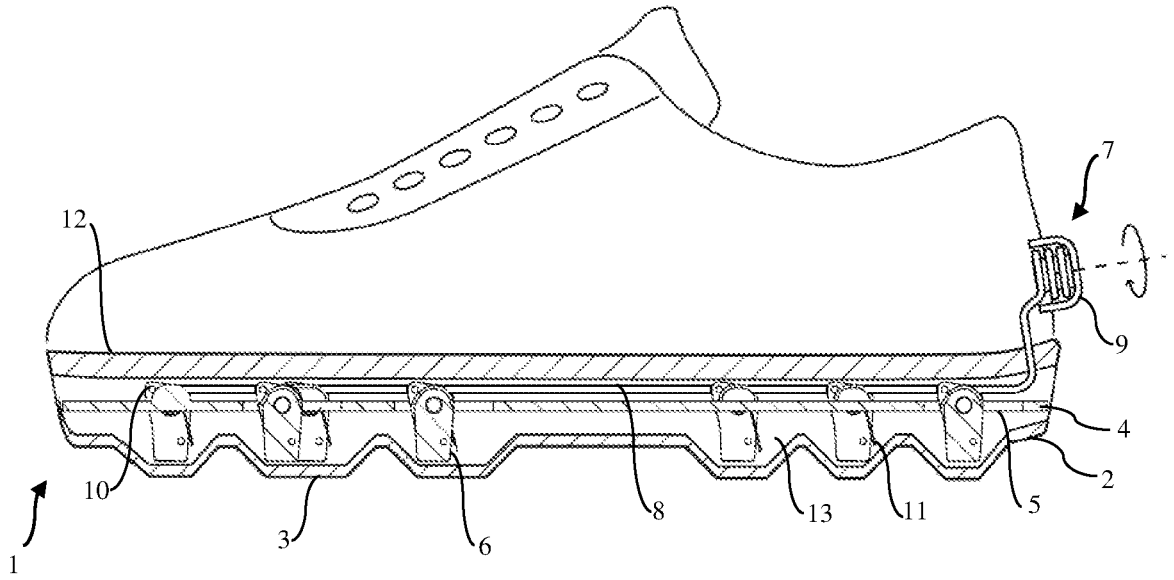

Reference will be made to the figures of the annexed drawings, wherein:

FIG. 1 represents a side view of a footwear sole according to the present description;

FIG. 2 represents a side view of a section of a footwear sole according to the present description;

FIG. 3 shows a top view of a footwear sole according to the present description;

FIG. 4 shows a bottom view of a footwear sole according to the present description;

FIG. 5 shows a side view of an actuated member according to the present description;

FIG. 6 shows a side view of a footwear according to the present description wherein the first layer is in a first configuration;

FIG. 7 shows a side view of a footwear according to the present description wherein the first layer is in a second configuration;

FIG. 8 represents a side section of a sole and a footwear according to the present description, wherein the first layer of the sole is in a second configuration.

ILLUSTRATIVE EMBODIMENTS

With reference to the attached figures, an embodiment of a footwear sole is indicated with the reference number 1.

The expression "footwear sole" means within the scope of the present description an element configured to be associated with a footwear, in particular with the top portion, for example with an upper, of a footwear.

According to an embodiment of the present description, the sole 1 comprises a first layer 2, or lower layer, intended, in use, to come into contact with the walking surface, or with the ground on which the footwear rests, during the walking of a user. More specifically, said first layer 2 has a leaning surface 3 configured to face, in use, said walking surface.

As can be seen in FIGS. 1 to 5, the footwear sole 1 according to the present description further comprises a second layer 4 coupled to said first layer 2. Such second layer 4 acts as a support or support element for a system suitable for modifying the configuration of said first layer 2. In fact, said second layer 4 of the sole 1 for footwear of the present description is configured to pass a first configuration, suitable for example to facilitate walking on flat surfaces, to a second configuration, which provides greater adherence for example on uneven or rough surfaces.

Preferably, said first layer 2 and said second layer 4 are flat and overlapped elements having the same shape, or substantially the same shape, of a user's foot sole. In particular, the footwear sole 1 comprises a main development direction L arranged, in use, parallel to the main development direction of a user's foot.

More specifically, the footwear sole 1 according to the present description comprises a plurality of seats 5 each of which associated with the second layer 4. According to an embodiment, each seat 5 of the plurality of seats is an opening, or through hole, in said second layer 4.

The footwear sole 1 further comprises a plurality of actuated members 6, configured to modify a configuration of the first layer 2 of the sole 1. Specifically, each actuated member 6 is mounted inside a respective seat 5 and can be moved between a first position, or retracted position to a second position, or extended position. Preferably, each member actuated 6 in this first position, or retracted position, is housed, preferably completely or substantially completely, or concealed, within a respective seat 5. In other words, in this first position, each of the actuated members 6 is arranged substantially in its entirety within the second layer 4, or does not protrude, or protrudes slightly, from said second layer 4. In the second position, or extended position, each of the actuated elements 6 protrudes at least partially from a respective seat 5 towards the first layer 2. For example, the actuated members 6 project, or protrude, or extend from said second layer 4 towards the first layer 2, in said second position, or extended position.

Still more specifically, according to an embodiment, each actuated member 6 is rotatably mounted in a respective seat 5 and is configured to rotate between said first position, or retracted position, and said second position, or extended position, and vice versa. Preferably, each actuated member 6 is an eccentric shaped element, or cam, fitted on an rotation axis R. Even more preferably, this rotation axis R is arranged perpendicularly to the main development direction L of the footwear sole 1. In other words, each of the actuated members 6 is substantially a plate element, pivotably mounted about an axis normal to a plane defined by said plate element, wherein such axis passes through a point different from the centre of the plate element itself.

Even more preferably, each actuated member 6 is an eccentric shaped element having a main development axis A. Preferably, when the actuated members 6 are arranged in said first position, or retracted position, their main development axis A is substantially parallel to the main development direction L of the footwear sole 1. Differently, when the actuated members 6 are arranged in said second position, or extended position, their main development axis A is substantially perpendicular to the main development direction L of the footwear sole 1.

Preferably, the number of seats 5 and respective actuated members 6 is variable. According to the embodiment shown in the figures, the number of seats 5 and actuated members 6 is 13. Preferably, at least one seat 5 and one actuated member 6 are arranged at the heel, or rear portion, of the sole 1 for footwear and at least one seat 5 and one actuated member 6 are arranged at the tip, or front region, of the footwear sole 1. Even more preferably, a plurality of seats 5 and actuated members 6 are arranged at the side regions of the footwear sole 1. Furthermore, according to an embodiment, at least one seat 5 and a respective actuated member 6 are arranged at the central region of the sole footwear 1, i.e. in the region arranged between said lateral regions of the footwear sole 1.

The plurality of actuated members 6, as said before, is configured to modify the configuration of the first layer 2. More specifically, the actuated members 6 in the first position, or retracted position, are apt to determine a first configuration of the first layer 2. Preferably in this first configuration of the first layer 2, the leaning surface 3 is substantially flat or free of bumps or protrusions. In such configuration of the first layer 2, the leaning surface 3 promotes maximum adherence to flat or substantially flat walking surfaces, such as for example house or office floors. The actuated members 6 in the second position, or extended position, are instead apt to determine a second configuration of the first layer 2. More specifically, in this second condition of the first layer 2 the leaning surface 3 has or forms a plurality of bumps or protrusions with respect to the first configuration of the first layer 2. Preferably, the number of such bumps or protrusions corresponds to the number of actuated members 6. Even more preferably, each of the protrusions of the plurality of protrusions is arranged at an actuated member 6.

According to a preferred embodiment, the second layer 4 defines with the first layer 2 an expandable chamber 13, or expansion chamber. That is to say that the first layer 2 and the second layer 4 are coupled together so as to define between them said expandable chamber 13, or expansion chamber. In other words, the first layer 2 and the second layer 4 are mutually associated so as to form an expandable empty or hollow space between them; wherein said empty or hollow space is called expandable chamber 13, or expansion chamber. Preferably, the movement of the actuated elements 6 determines the contraction or expansion of this expandable chamber 13, or expansion chamber. This contraction or expansion of the expandable chamber 13, or expansion chamber, in turn, changes the configuration of the first layer 2. Advantageously therefore, the actuated members 6 are arranged inside such expandable chamber 13, or expansion chamber. This prevents direct contact between the actuated elements 6 and the walking surface, reducing wear and/or reducing the risk of breaking the actuated elements 6. In other words, the movement of the actuated elements 6 acts on the second layer 4 by means of the expansion or contraction of the expandable chamber 13, or expansion chamber. That is to say that the first position of the actuated members 6, i.e. the retracted position, corresponds to a maximum proximity or closeness of the first layer 2 with respect to the second layer 4 at the expansion chamber 13, while the second position of the actuated members 6, or extended position, corresponds to a maximum distance or separateness of the first layer 2 with respect to the second layer 4 at the expansion chamber 13. In other words, in the first position, i.e. in the retracted position, the actuated elements 6 determine a maximum proximity of the first layer 2 with respect to the second layer 4 at the expansion chamber 13; while in the second position, i.e. in the extended position, the actuated elements 6 determine a maximum distance or separateness of the second layer 4 with respect to the first layer 2, with consequent expansion of the expansion chamber 13. In other words, in the transition from the retracted position to the position extended, the actuated members 6 are configured to move away or distance the second layer 4 from the first layer 2.

In order to move the actuated members 6 from the first position, or retracted position, to the second position, or extended position, and vice versa, the footwear sole 1 according to the present description comprises an actuation member 7. This actuation member 7 comprises at least two elements tie rods 8 which are configured to simultaneously rotate each member of the plurality of actuated members 6 from the first position to the second position. In other words, the actuation member 7 comprises at least two tie-member elements 8 which are connected in parallel to a plurality of actuated elements 6 and allow a synchronous movement of the latter. The two tie rods 8 are associated with each actuated member of the plurality of actuated members 6. In other words, the two tie rods 8 are associated with the actuated members 6 and are configured to simultaneously or contemporaneously operate the movement of the actuated members 6 between the extended position and the retracted position, and vice versa.

More specifically, each actuated member 6 of the plurality of actuated members 6 comprises a hole 10 within which at least one of said tie-members 8 is inserted. Each actuated member 6 is therefore provided with a hole 10, or ring, inside which at least one tie-member 8 is passed through. In this way, each actuated element 6 is connected to a tie-member 8.

The actuation member 7 further comprises a rotor 9 connected to the at least two tie-members 8. Preferably, the rotor 9 is a rotating element on which a tie-members 8 end is wound. Preferably, the rotor 9 can be manually operated by a user, for example by manually rotating such element, or can be electronically operated. That is to say that the rotor 9 can be electronically or manually operated, i.e. actuated or activated. Said rotor 9 is also configured to control the tie-members 8 tensioning. For example, a rotation of the rotor 9 in a first rotation direction causes the tensioning, or an increase in tension, of the tie-members 8, while a rotation of the rotor 9 in a rotation direction opposite to said first rotation direction causes a release, or a loosening, of the tie-members 8. That is to say that the rotation of the rotor 9 in a first rotation direction causes a condition of tension of the tie-members 8, while the rotation of the rotor 9 in a second rotation direction, opposite to the first, determines a release, loosening or non-tensioning condition of the tie-members 8. Preferably, a rotation in the first rotation direction of the rotor 9 is apt to determine a movement of the actuated members 6 from the first position, or retracted position, to the second position, or extended position. Preferably, moreover, such movement from the first to the second position of the actuated members 6 is due to the tie-members 8 tensioning.

Preferably, the footwear sole 1 further comprises a third layer 12 arranged in such a way that said second layer 4 is arranged between the first layer 2 and said third layer 12. In other words, the arrangement of the layers of the footwear sole 1 is such that the first layer is configured to face, in use, the walking surface, and the third layer 12 is configured to face, in use, a user's foot. Even more preferably, the three layers of the sole 1 are arranged and sized so that the actuated members 6 and the actuation member 7 are completely housed between the first layer 2 and the third layer 12 so as not to hinder a user's walk. According to a preferred embodiment, the first and/or third layer 2, 12 are layers of elastic material, preferably of rubber.

Preferably moreover, the rotor 9 is arranged at an end region of the sole 1. For example, the rotor 9 is arranged at a rear region of the footwear sole 1. More specifically, the rotor 9 is arranged at the heel region of the sole 1 so that, at the same time, the tie-members 8 tensioning can be easily adjusted by a user and not to disturb the user during the walk.

According to an embodiment, the actuation member 7 further comprises a torsion spring 11. Preferably, the actuation member 7 comprises a plurality of torsion springs 11, each of which is housed inside a seat 5 of the plurality of seats and connected to the actuated member 6 arranged in the same seat 5. Therefore, each of the torsion springs 11 is associated with a respective actuated member 6 and with the seat 5 occupied by the latter. Preferably the torsion springs 11 are arranged in the seats 5 and connected to the respective actuated members 6 so as to counteract the action of the tie-members 8 on these actuated members 6. Preferably also, the torsion springs 11 can exert their action on a pin 14, or protrusion, of each of the actuated members 6. Preferably, each of the torsion springs 11 is fixedly mounted in a respective seat 5, for example on the rotation axis R of the actuated members 6. Specifically, the arrangement of the torsion springs 11 in the seats 5 and their connection with the actuated members 6 is such that a rotation of the rotor 9 in the first rotation direction is apt to cause a twisting movement and a loading of the torsion springs 11. At the same time, the arrangement of the torsion springs 11 in the seats 5 and their connection with the actuated members 6, is such that a rotation of the rotor 9 in the rotation direction opposite to said first rotation direction is apt to release the tie rods 8 and allow the rotation of the actuated elements 6 from the second position, or extended position, to the first position, or retracted position, under the action of the torsion spring 11 itself. In other words, the rotation of the rotor 9 in the first rotation direction is apt to cause a twisting and loading of the torsion springs 11. Conversely, a rotation of the rotor 9 in a second rotation direction, opposite to the first rotation direction, it is apt to cause the tie-members 8 and the torsion springs 11 loosening or release and to allow a movement, in particular a rotation, of the actuated elements 6 from the second position, or extended position, to the first position, or retracted position. That is to say that the rotation of the rotor 9 in a rotation direction opposite to the first rotation direction is capable of causing a loosening of the tie-members 8, thus allowing each torsion spring 11 to cause the actuated member 6, to which it is associated, to move to from the second position to the first position.

A further object of the present description is a footwear 20 comprising the footwear sole 1 described so far. This footwear 20 is represented in FIGS. 6 to 8.

According to a preferred embodiment, the rotor 9 is arranged at a rear region of said footwear 20, preferably integral with a heel region of the footwear itself.

Finally, the present description relates to a method for modifying the configuration of a leaning surface 3 of a sole 1 for footwear, wherein said leaning surface 3 is configured to face, in use, a walking surface. Specifically, the method object of the present description provides providing a first layer 2 of a footwear sole 1, wherein said first layer 2 defines said leaning surface 3. The method further comprises a step of coupling of said first layer 2 with a second layer 4 and providing a plurality of seats 5 each associated with this second layer 4. A plurality of actuated members 6 are also provided, each mounted in their respective seat 5, and such actuated members 6 are mounted in the respective seats 5 so that they can be moved between a first position, or a retracted position, wherein they are housed inside a respective seat 5, and a and a second position, or extended position, wherein they protrude at least partially from a respective seat 5 towards the first layer 2.

The method then provides the provision of an actuation member 7 configured to move the actuated members 6 and moving the latter between the first position, or retracted position, and the second position, or extended position. In particular, the plurality of elements actuated 6 in the respective first position, or retracted position, are apt to determine a first configuration of the first layer 2, while in the respective second position, or extended position, they apt to determine a fa second configuration of the first layer 2. More specifically, in said second configuration of the first layer 2 the leaning surface 3 has or forms a plurality of bumps or protrusions with respect to the first configuration of the first layer 2 at each actuated member 6. In said first configuration of the first layer 2, the leaning surface 3 is substantially planar, that is, flat or free of said bumps or protrusions.

According to an embodiment, the second layer 4 defines with the first layer 2 an expandable chamber 13, or expansion chamber. In other words, upon the coupling of the first layer 2 with the second layer 4 it defines with an expandable chamber 13, or expansion chamber, between said first layer 2 and said second layer 4. Specifically, according to this embodiment, the movement of the actuated members 5 causes a contraction or expansion of this expandable chamber 13 which in turn changes the configuration of the first layer 2.

Preferably each actuated member 6 is an eccentric shaped element, or cam, rotatably mounted in a respective seat 5. Each actuated member 6 is therefore configured to rotate between the first position, or retracted position, and the second position, or extended position, and viceversa. Each actuated member 6 therefore rotates between the first position, or retracted position, and the second position, or extended position, and vice versa.

Preferably, the sole 1 comprises a main development direction L arranged, in use, parallel to the main development direction of a user's foot, and wherein each actuated member 6 of the plurality of actuated members 6 is an eccentric shaped element, or cam, fitted on an rotation axis R perpendicular to said main development direction L of sole 1. In other words, sole 1 mainly develops or extends a main development direction L. This main development direction L is parallel, in use, to the main development direction of a user's foot. The actuated members 6 are elements of an eccentric shape, or cams, fitted on an rotation axis R perpendicular to the main development direction L of the sole 1.

Preferably, each actuated member 6 of the plurality of actuated members 6 has a main development axis A, said main development axis A being substantially parallel to the main development direction L of the sole 1 in said first position, or retracted position, and substantially perpendicular to the main development direction L of the sole 1 in said second position, or extended position. That is to say that each actuated member 6 develops mainly along a main development axis A. This main development axis A is parallel to the main development direction L, when the actuated member 6 is in said first position, or retracted position and it is perpendicular to the main development direction L, when the actuated member 6 is in said second position, or extended position.

Preferably, providing said actuation member 7 comprises providing at least two tie-members 8 configured to simultaneously rotate a plurality of actuated elements 6 each from the first position, or retracted position, to the second position, or extended position.

Preferably, providing said actuation member 7 further comprises providing a rotor 9, configured to control the tensioning of the tie-members 8, and connecting said rotor 6 to the at least two tie-members 8. More specifically, the actuation member 7 configured to move the actuated members 6 comprises a rotor 9 which is connected to at least two tie-members 8 and is configured to control these tie-members 8 tensioning. The latter are also connected to at least one actuated element 6. Specifically, this configuration allows the fact that the movement phase of the actuated elements 6 between the first position and the second position can be carried out by means of the tie rods 8 upon rotation of the rotor 9. In general, the movement of the actuated members 6 occurs by changing the tension of the tie rod elements 8. Preferably a rotation of the rotor 9 in a first rotation direction causes an increase in the tie-members 8 tensioning which promotes the rotation of the members 6 from the first position, or retracted position, to the second position, or extended position. That is, by rotating the rotor 9 in a first rotation direction, the tie-members 8 are tensioned causing a movement of the respective actuated member 6 from the first position, or retracted position, to the second position, or extended position. In other words, the step of moving said plurality of actuated elements 6 between the first position, or retracted position, and the second position, or extended position, and vice versa comprises rotating the rotor 9 in a first rotation direction to tension the elements tie rods 8 causing a movement of the respective actuated member 6 from the first position, or retracted position, to the second position, or extended position.

According to a preferred embodiment, providing said actuation member 7 further comprises providing a torsion spring 11 for each actuated member of the plurality of actuated members 6, coupling said torsion spring 11 to an actuated member of the plurality of actuated members 6, housing the torsion spring 11 in the respective seat 5 of the actuated member of the plurality of actuated members 6 to which it is coupled. Hence, the actuation member 7 further comprises a torsion spring 11 housed inside each of the seats 5 and connected to the actuated element 6 housed inside each of these seats 5. Preferably, each of the torsion springs 11 it is fixedly mounted inside a respective seat 5.

According to this embodiment, the step of moving the plurality of actuated elements 6 between the first position, or retracted position, and the second position, or extended position, and vice versa comprises:

rotating the rotor 9 in the first rotation direction causing a twisting movement of the tie-members 8 and a loading of the torsion springs 11, wherein said twisting movement of the tie-members 8 causes a movement of the actuated elements 6 from the first position, or retracted position, to the second position, or extended position, and impedes the release of the torsion springs 11 preventing the movement of the actuated elements 6 from the second position, or extended position, to the first position, or retracted position;

rotating the rotor 9 in a second rotation direction, opposite to the first, causing a loosening of the tie-members 8 which allows the torsion springs 11 to move the actuated elements 6 from the second position, or extended position, to the first position, or position retracted.

That is to say that the rotation of the rotor 9 in the first rotation direction causes a twisting movement and a loading of the torsion springs 11. In this configuration, the movement of the actuated members 6 from the second position, or extended position, to the first position, o retracted position due to the action of the torsion spring 11 is prevented by the tie-members 8 tensioning. On the contrary, a rotation of the rotor 9 in a rotation direction opposite to the first rotation direction is apt to release the tie-members 8 and said torsion spring 11 and allowing rotation of the actuated member 6 from the second position, or extended position, to the first position, or retracted position, under the action of the torsion spring 11. In other words, this rotation of the rotor 9 in the rotation direction opposite to the first rotation direction causes a loosening of the tie-members 8 which allows the torsion spring 11 in each of the seats 5 to move the actuated members 6 from the second position to the first position.

Any variations or additions may be made by those skilled in the art to the embodiment described and illustrated herein, remaining within the scope of the following claims. In particular, further embodiments may include the technical characteristics of one of the following claims with the addition of one or more technical characteristics described in the text or illustrated in the drawings, taken individually or in any reciprocal combination.

The invention claimed is:

1. A footwear sole comprising:

a first layer having a leaning surface configured to face, in use, a walking surface;

a second layer, coupled to said first layer;

a plurality of seats each associated with the second layer;

a plurality of actuated members each mounted in a respective seat of the plurality of seats, wherein each actuated member of the plurality of actuated members is movable between a first position, or retracted position, wherein each actuated member of the plurality of actuated members is situated inside a corresponding seat and a second position, or extended position, wherein the actuated member projects at least partially from a respective seat towards said first layer;

an actuation member configured to move the plurality of actuated members between the retracted position and the extended position and vice versa, wherein the plurality of actuated members are disposed in an expandable chamber defined by the first layer and the second layer, wherein the plurality of actuated members in the respective first position, or retracted position, determine a first configuration of the first layer wherein the leaning surface is substantially flat or free of protrusions, and wherein the plurality of actuated members in the respective second position, or extended position, determine a second configuration of the first layer wherein in said second configuration of the first layer the leaning surface has or forms a plurality of bumps or protrusions with respect to the first configuration of the first layer wherein each bump or protrusion of said plurality of bumps or protrusions is arranged at the corresponding actuated member of the plurality of actuated members.

2. The footwear sole according to claim 1, wherein the movement of the plurality of actuated members causes a contraction or expansion of the expandable chamber which modifies the configuration of the first layer.

3. The footwear sole according to claim 2, wherein in the first position, or retracted position, the plurality of actuated members determine a maximum proximity of the first layer with respect to the second layer at the expansion chamber, while in the second position, or extended position, the plurality of actuated members determine a maximum distance of the second layer with respect to the first layer at the expansion chamber.

4. The footwear sole according to claim 1, wherein each actuated member of the plurality of actuated members is rotatably mounted in a respective seat of the plurality of seats and is configured to rotate between the first position, or retracted position, and the second position, or extended position, and vice versa.

5. The footwear sole according to claim 4, wherein the sole comprises a main development direction (L) arranged, in use, parallel to a main development direction of a user's foot when in use, and wherein each actuated member of the plurality of actuated members is an eccentric shaped element, or cam, fitted on a rotation axis (R) perpendicular to said main development direction (L) of the sole.

6. The footwear sole according to claim 5, wherein each actuated member of the plurality of actuated members has a main development axis (A), said main development axis (A) being substantially parallel to the main development direction (L) of the sole in said first position, or retracted position, and substantially perpendicular to the main development direction (L) of the sole in said second position, or extended position.

7. The footwear sole according to claim 1, wherein the actuation member comprises at least two tie-members configured to rotate simultaneously the plurality of actuated members each from the first position, or retracted position, to the second position, or extended position.

8. The footwear sole according to claim 7, wherein the actuation member comprises a rotor connected to the at least two tie-members and configured to control the tensioning of the tie-members.

9. The footwear sole according to claim 8, wherein each actuated member of the plurality of actuated members comprises a hole and wherein at least one tie-member is inserted in said hole, wherein a rotation of the rotor in a first rotation direction causes a movement of the respective actuated member from the first position, or retracted position, to the second position, or extended position, through the tie-members.

10. The footwear sole according to claim 8 or 9, wherein the actuation member further comprises a plurality of torsion springs, wherein each torsion spring of the plurality of springs twisting is housed inside each of said plurality of seats and connected to a respective actuated member, wherein said rotation of said rotor in said first rotation direction determines a twisting movement of the torsion springs and a loading of the torsion springs themselves, and wherein a rotation of the rotor in a rotation direction opposite to said first rotation direction releases said tie-members and said torsion springs and allow a rotation of the plurality of actuated members from the second position, or extended position, to the first position, or retracted position, under the action of torsion springs.

11. The footwear sole comprising a sole for footwear according to claim 1.

12. The footwear sole according to claim 1, wherein said second layer defines with said first layer the expandable chamber.

13. The footwear sole according to claim 12, wherein the movement of the plurality of actuated members causes a contraction or expansion of the expandable chamber which modifies the configuration of the first layer.

14. The footwear sole according to claim 13, wherein in the first position, or retracted position, the plurality of actuated members determine a maximum proximity of the first layer with respect to the second layer at the expansion chamber, while in the second position, or extended position, the plurality of actuated members determine a maximum distance of the second layer with respect to the first layer at the expansion chamber.

15. The footwear sole comprising a sole for footwear according to claim 13.

16. A method for modifying the configuration of a leaning surface of a sole for footwear, the leaning surface being configured to face, in use, towards a walking surface, wherein the leaning surface is substantially flat or free of protrusions; the method comprising the following steps:

providing a first layer of a sole for footwear, said first layer defining said leaning surface;

coupling said first layer to a second layer;

providing a plurality of seats each associated with the second layer and providing a plurality of actuated members each mounted in a respective seat of the plurality of seats, an actuated member of the plurality of actuated members being movable between a first position, or retracted position, wherein the actuated member of the plurality of actuated members is then housed inside the corresponding respective seat of the plurality of seats, and a second position, or extended position, wherein the actuated member of the plurality of actuated members projects at least partially from the corresponding respective seat of the plurality of seats towards the first layer;

providing an actuation member configured to move the plurality of actuated members; moving the plurality of actuated members between the first position, or retracted position, and the second position, or extended position;

wherein the plurality of actuated members in the respective first position, or retracted position, are configured to determine a first configuration of the first layer, and wherein the plurality of actuated members in the respective second position, or extended position, are configured to determine a second configuration of the first layer, wherein in said second configuration of the first layer the leaning surface has or forms a plurality of bumps or protrusions with respect to the first configuration of the first layer at each actuated member of the plurality of actuated members.

17. The method according to claim 16, wherein said second layer defines with said first layer an expandable chamber or expansion chamber.

18. The method according to claim 17, wherein the movement of the plurality of actuated members causes a contraction or expansion of the expandable chamber or expansion chamber which modifies the configuration of the first layer.

19. The method according to claim 17 or 18, wherein the actuation member comprises providing at least two tie-members configured to rotate a plurality of actuated members each from the first position, or retracted position, to the second position, or extended position, simultaneously.

20. The method according to claim 19, wherein said actuated member further comprises providing a rotor, configured to control a tensioning of tie-members and connecting said rotor to the at least two tie-members.

21. The method according to claim 20, wherein said step of moving the plurality of actuated members between the first position, or retracted position, and the second position, or extended position, and vice versa, comprises rotating the rotor in a first rotation direction in order to tension the tie-members thereby determining a movement of the respective actuated member of the plurality of actuated members from the first position or retracted position, to the second position, or extended position.

22. The method according to claim 21, wherein providing the actuation member further comprises providing a plurality of torsion springs, a torsion spring of the plurality of torsion springs provided for each actuated member of the plurality of actuated members, coupling said torsion spring of the plurality of torsion springs with the corresponding actuated member of the plurality of actuated members, housing said torsion spring of the plurality of torsion springs in the respective seat of the actuated member of the plurality of actuated members to which said torsion spring of the plurality of torsion springs is coupled to.

23. The method according to claim 22, wherein said step of moving the plurality of actuated members between the first position, or retracted position, and the second position, or extended position, and vice versa, comprises: rotating said rotor in said first rotation direction determining a twisting movement of the plurality of torsion springs and a loading of the plurality of torsion springs, wherein said twisting movement of the plurality of torsion springs causes a movement of the plurality of actuated members of the plurality of actuated members from the first position, or retracted position, and the second position, or extended position, and impedes the release of the plurality of torsion springs, preventing the movement of the plurality of actuated members from the second position, or extended position, to the first position, or retracted position; rotating the rotor in a second rotation direction, opposite to the one, determines a loosening of said tie-members that allows the torsion springs to move the plurality of actuated members from the second position, or extended position, to the first position, or retracted position.

* * * * *